United States Patent [19]

Bahnsen et al.

[11] 4,408,097

[45] Oct. 4, 1983

[54] AM-FM RADIO RECEIVER FOR RECEIVING AM-STEREO SIGNALS

[75] Inventors: Bahne P. Bahnsen, Henstedt-Ulzburg; Willy Kanow, Schenefeld, both of Fed. Rep. of Germany

[73] Assignee: U.S. Philips Corporation, New York, N.Y.

[21] Appl. No.: 259,797

[22] Filed: May 4, 1981

[30] Foreign Application Priority Data

Jun. 27, 1980 [DE] Fed. Rep. of Germany ..... 3024085

[51] Int. Cl.[3] ..... H04H 5/00

[52] U.S. Cl. ..... 381/15; 329/135; 329/142

[58] Field of Search ..... 179/1 GB, 1 GM, 1 GN, 179/1 GS; 329/135, 141–143; 455/142–144, 227–229

[56] References Cited

U.S. PATENT DOCUMENTS 3,311,838 3/1967 Danker ..... 329/135 X
3,919,645 11/1975 Ohsawa et al. ..... 329/135 X
4,160,955 7/1979 Sato ..... 329/135 X
4,201,946 5/1980 McFadyen ..... 329/142 X

*Primary Examiner*—A. D. Pellinen
*Attorney, Agent, or Firm*—Jack Oisher; William J. Streeter; Edward W. Goodman

[57] ABSTRACT

An AM-FM receiver which uses the FM-demodulator for demodulating the phase modulated sidebands of an AM-stereo signal. Therefore, it has to operate as a FM-demodulator also at the AM-intermediate frequency which is achieved by means of a parallel resonant circuit tuned to the AM-intermediate frequency (455 KHz) and arranged in series with a parallel resonant circuit which is tuned to the FM-intermediate frequency (10.7 MHz). The FM-demodulator is followed by an integrating circuit which only becomes operative in the event of AM-reception and which forms a phase demodulator in conjunction with the FM-demodulator. The additional costs and efforts for the reception of AM-stereo signals is therefore extremely small. In addition to the components which are already required in an AM-FM radio receiver only a further parallel resonant circuit and an integrating circuit are required.

1 Claim, 2 Drawing Figures

AM-FM RADIO RECEIVER FOR RECEIVING AM-STEREO SIGNALS

BACKGROUND OF THE INVENTION

The invention relates to an AM-FM radio receiver having an FM-demodulator which comprises a network which resonates at the FM intermediate frequency.

Radio receivers of this type are generally known. They are inter alia used for the reception of FM-stereo signals (in accordance with the FCC stereo standard). There are, however, also AM-stereo broadcasts, that is to say transmissions in which stereo signals are transmitted in the medium-wave band.

In accordance with the relevant US-standards such an AM-stereo signal consists of a sum signal (i.e. a signal equal to the sum of the instantaneous values the left and in right channels), which, as is the general practice, is modulated on the carrier frequency, and a difference signal which (together with a 5 Hz stereo-program identification signal) is phase-modulated on the same carrier.

Such an AM-stereo signal can be decoded by employing a phase demodulator in addition to the customary AM-demodulator. The phase demodulator output signal, which corresponds to the difference signal, must be combined in a suitable matrix circuit with the amplitude demodulator output signal, which corresponds to the sum signal, in such manner that the signals for the left and the right channels are produced. Such a receiver requires at least one additional phase demodulator.

SUMMARY OF THE INVENTION

The invention has for its object to provide a AM-FM receiver of such a construction that AM-stereo signals of the type described in the foregoing can be received with little extra effort and cost.

According to the invention, this object is accomplished in that at the reception of AM-stereo signals with the difference signal (L-R) being phase-modulated on a carrier, the AM-intermediate frequency signal is applied to the FM-demodulator, the above-mentioned network thereof having a further resonant frequency at the AM-intermediate frequency, as integrating circuit being connected behind the FM-demodulator.

In accordance with the invention the FM-demodulator already present is employed as a phase demodulator on receipt of an AM-stero signal. To this end the frequency-dependent network comprised in the frequency demodulator must be of such a construction that it has, in addition to a resonant frequency, at the FM-intermediate frequency also a resonant frequency at the AM-intermediate frequency, so that the FM-demodulator is also capable of demodulating frequency-modulated signals in the AM-intermediate frequency band (for example 455 kHz.) As an FM-demodulator generates output signals the amplitude of which is proportional to the frequency modulation, it is necessary to provide an integrating circuit in order to obtain a signal the amplitude of which is proportional to the phase modulation. This is because after frequency detection in the FM-demodulator, a phase-modulated signal results in a low-frequency signal, which is proportional to the modulation frequency. By means of integration this proportionality is cancelled, so that the desired modulation frequency is obtained. (As known the phase sweep, that is to say the quotient of the frequency sweep and the modulation frequency is constant.)

In the most simple case, an FM-demodulator comprises a parallel-resonant circuit as a frequency-dependent network. In that event, a further embodiment in accordance with the invention accomplishes that the network comprises a further parallel-resonant circuit tuned to the AM-intermediate frequency, and that the two parallel-resonant circuits are arranged in series. It is also possible to use a series resonant circuit tuned to the FM-intermediate frequency as the frequency-determining network of the FM-demodulator and a further series resonant circuit tuned to the AM-intermediate frequency which two series resonant circuits are connected in parallel with respect to each other.

It is known that many types of FM-demodulators cannot suppress an AM-demodulation contained in their input signal, so that distortions occur. Such FM-demodulators are therefore always preceeded by a limiting amplifier which produces an output signal, the amplitude of which is constant and independent of the input amplitude. Whereas AM-modulation occurs only as an interference at an FM-signal, it is in principle always present in an AM-stereo signal because of the fact that not only the phase but also the amplitude of the carrier are modulated. A further embodiment of the invention now provides that the AM-intermediate frequency signal is applied to the limiting amplifier. In that event not only the FM-demodulator but also the limiting amplifier preceeding it are utilized, both in AM and in FM receiving mode.

DESCRIPTION OF THE DRAWING

The invention will now be further described by way of example with reference to an embodiment shown in the accompanying drawing.

DESCRIPTION OF THE PREFERRED EMBODIMENT

Figure 1:
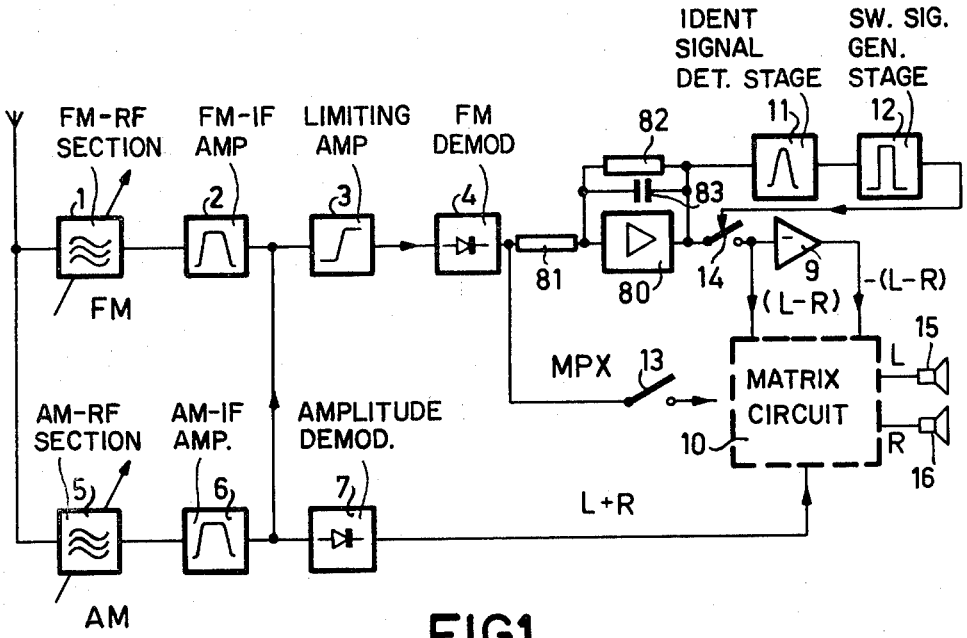
FIG. 1 shows a block schematic circuit diagram of a receiver in accordance with the invention.

With the receiver shown in FIG. 1, the aerial signal is applied to an FM-RF section 1 and also to an AM-RF section 5. Each RF-section comprises in known manner an input (filter) stage, a tunable oscillator and a mixer stage and produces an output signal in the intermediate frequency range which is located in the FM-channel at 10.7 MHz and in the AM-channel at 455 kHz. The intermediate frequency signals are amplified in an intermediate frequency amplifier 2 in the FM-channel and in an intermediate frequency amplifier 6 in the AM-channel. The output signal of the intermediate frequency amplifier 2 is applied to an FM-demodulator 4, via a limiting amplifier 3, the output signal of which has a constant amplitude which is independent of the input amplitude and which removes a superposed amplitude modulation from the signal. Said FM-demodulator 4 delivers a signal, the amplitude of which is proportional relative to the deviation of the frequency of the input signal as regard to the intermediate frequency (for example 10.7 MHz). An FM-demodulator usually comprises a network which resonates at the FM-intermediate frequency, (for example 10.7 MHz) and in so doing produces a 90° phase shift with respect to the input signal. If the instantaneous frequency of the input signal differs from the intermediate frequency, the value of the phase shift changes correspondingly.

The output signal of the AM-intermediate frequency amplifier 6 is applied to an amplitude demodulator 7, the output signal of which corresponds to the fluctuations in the amplitude of the carrier which is stepped down to the AM-intermediate frequency. If an AM-stereo signal is transmitted the output signal of the amplitude demodulator 7 corresponds to the sum signal (L+R).

Up to this point the circuit is fully known.

In accordance with the invention the output signal of the AM-intermediate frequency amplifier 6 is also applied to the input of the limiting amplifier 3 and to the FM-demodulator 4 via said limiting amplifier.

Figure 2:
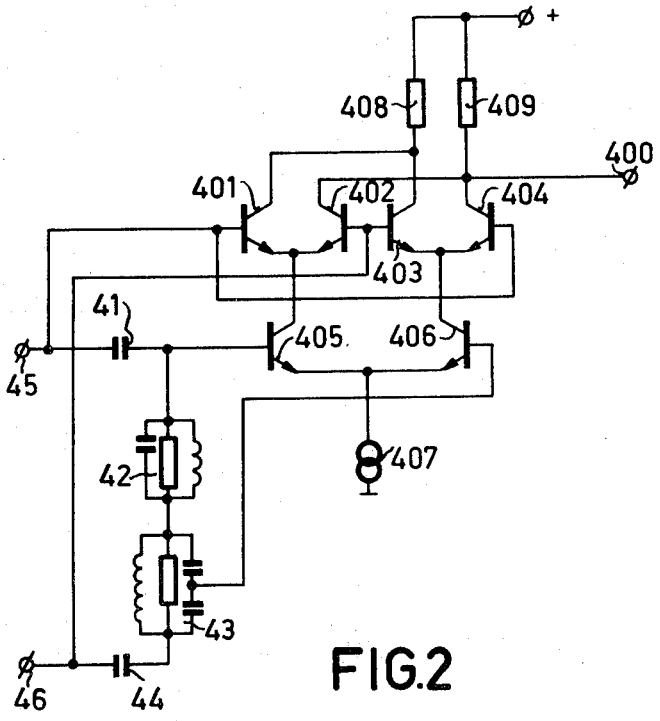
FIG. 2 shows the circuit diagram of the FM-demodulator.

The construction of said FM-demodulator 4 is shown in detail in FIG. 2. It predominantly comprises a network which, depending on the signal frequency, shifts the phase of the signal with respect to the input signal, and a multiplier circuit which multiplies the two signals with each other.

The multiplier circuit comprises four cross-wise coupled transistors 401 . . . 404, each transistor of these four transistors having one single electrode in common with each one of the three other transistors. The collector of a transistor 405 is connected to the interconnected emitter leads of the transistors 401 and 402 and the collector of a transistor 406 is connected to the emitter leads of the transistors 403 and 404. The emitters of the transistors 405 and 406 are interconnected and a direct current source 407 is included in the common emitter supply wire, said current source producing a constant current. The interconnected collectors of the transistors 401 and 403 are connected to the positive supply voltage terminal via a resistor 408; in a corresponding manner the junction of the collectors of the transistors 402 and 404, which at the same time represent the output 400 of the FM-demodulator, is connected to the positive supply voltage terminal via a resistor 409. The signal whose phase is shifted by the network is applied between the base electrodes of the transistors 405 and 406, while the input signal, present on the terminals 45 and 46, is applied between the bases of the transistors 401 and 402, which are connected to the bases of the transistors 404 and 403, respectively. Up to this point this multiplier circuit is fully known, also for the purpose of frequency demodulation (see German Auslegeschrift 1766837).

The phase-shifting network is included between the terminals 45 and 46 and comprises two capacitors 41 and 44, each having a capacitance of 33 pF and being connected to the input terminals 45 and 46, their electrodes which face away from the input terminals being interconnected via two series-arranged parallel resonant circuits 42 and 43. The parallel resonant circuit 42 comprises a capacitor which has a capacitance of 560 pF, and is tuned to the FM-intermediate frequency (10.7 MHz), a parallel-arranged resistor reducing the quality of this circuit to the required value (for example 25). The parallel resonant circuit 43 comprises two series-arranged capacitors having a capacitance of 820 pF and 1.8 nF, respectively, and is tuned to the AM-intermediate frequency (455 kHz), also now a parallel arranged resistor for obtaining the required bandwidth being provided. The terminal of the capacitor 41 which faces away from the input terminal is connected to the base of the transistor 405 and the corresponding electrode of the capacitor 44 is connected to the base of the transistor 406 via a lower capacitor of the parallel resonant circuit 43.

The phase shift between the input signal and the signal derived from the network and applied to the bases of the transistors 405 and 406 is 90° at one of the two resonant frequencies. In the range of the FM-intermediate frequency, the capacitors of the parallel resonant circuit 43, which is tuned to the AM-intermediate frequency (455 KHz), constitute in actual practice a shortcircuit, while in the range of the AM-intermediate frequency the coil of the parallel resonant circuit 42 which is tuned to the FM-intermediate frequency constitutes a short circuit.

So the frequency demodulator described in the foregoing, produces at its output terminal 400 a signal whose amplitude is proportional to the frequency difference between the signal-frequency applied to the terminals 45 and 46 and the FM-IF and the AM-IF, respectively. Therefore, it operates as an FM-demodulator for signals in the frequency range of both the FM-intermediate frequency and the AM-intermediate frequency.

As can be seen from FIG. 1, the output signal of the FM-demodulator is applied via a line MPX to a switch 13 which is open in the case of AM-reception. A circuit portion, not further shown, which further processes the signals which are received from the FM-radio frequency section 1 and demodulated by the demodulator 4, for example a stereo decoder, may be connected to this switch. In addition, an integrating circuit which in conjunction with the frequency demodulator 4 operates as a phase demodulator is connected to the output of the frequency demodulator.

The integrating circuit is in the form of an amplifier 80 having a sufficiently high gain the inverting input of which is connected to the output of the FM-demodulator 4 via a variable resistor 81 having a value of 2.2 kOhm and to its own output via a capacitor 83 having a capacitance of 2.2 nF. A resistor 82 which is arranged in parallel with the capacitor 83 and which is dimensioned so that it only affects the frequency variation of the integrating element at very low frequencies (for example 20 Hz) has for its function to obtain defined d.c. setting voltages at the input and the output of the amplifier 80.

The output signal of the integrating circuit and of the amplifier 80, respectively, contains, on reception of an AM-stereo signal, the difference signal L-R and also an identification signal having a frequency of 5 Hz, which indicates the presence of an AM-stereo signal. By means of a stage 11, said identification signal is detected and applied to a switching signal generating stage 12 which produces a switching signal. At the occurence of the 5 Hz stereo identification signal, a switch 14 is closed, which connects the common outputs of the integrating circuit and the amplifier 80 to the input of an inverting amplifier 9. The input of this amplifier 9, which carries the difference signal L−R, and its output which carries the inverted difference signal −(L−R) are connected to a circuit portion 10 to which also the output of the amplitude demodulator 7 is connected. The circuit portion 10 comprises a matrix circuit which produces from the difference signal (L−R) and from the inverted difference signal and the sum signal (L+R), respectively, the signals L for the left-hand channel and R for the right-hand channel. In addition, the circuit portion 10 comprises two amplifiers for amplifying the two signals. Two loudspeakers 15 and 16 for the acoustic reproduction of the two signals, are connected to the output of the circuit portion 10. As the case may be, the matrix circuit may be part of a decoder for decoding FM-stereo signals, for also then sum and difference signals must be combined to derive therefrom signals L, R for the left-hand and the right-hand channel, respectively.

In the event of FM-reception, the AM-radio frequency section 5 of the receiver is in the switched-off state. Via the FM-radio frequency section 1, the aerial signal is converted, amplified and demodulated into a FM multiplex signal MPX which via the switch 13 being in the closed state, is further processed in a subsequent circuit portion. The switch 14 is then open.

In the event of AM-reception, the FM-radio frequency section 1 is switched off and the aerial signal is converted and amplified in the AM-intermediate frequency band by the components 5 and 6. If no AM-stereo signal is transmitted no signal is produced at the output of the integrating circuit 80–83, more specifically no 5 Hz stereo-identification signal, as the phase of the carrier of the AM-signal is not modulated. The switch 14 is then open and only the output signal of the amplitude demodulator 7 is applied to the circuit portion 10 comprising the matrix circuit, said signal after having been amplified to the same extent, being applied to the loudspeakers 15 and 16. When an AM-stereo identification signal is received the 5 Hz stereo-identification signal is produced at the common outputs of the integrating circuit and the amplifier 80 so that the switch 14 is closed via the components 11 and 12. The difference signal which is applied directly (L−R) and after phase reversal −(L−R), respectively, to the circuit portion 10 is added to the sum signal L+R from the output of the amplitude demodulator 7 to be split in the matrix circuit 10 into the signals L and R and applied to the loudspeakers 15 and 16, respectively.

What is claimed is:

1. An AM-FM radio receiver having an FM-RF section and an AM-RF section each coupled to an aerial input, an FM intermediate frequency amplifier coupled to said FM-RF section, an AM intermediate frequency amplifier coupled to said AM-RF section, an FM demodulator coupled to said FM intermediate frequency amplifier by a limiting amplifier, an amplitude demodulator coupled to said AM intermediate frequency amplifier, and a matrix circuit coupled to both said FM and amplitude demodulators, characterized in that on the reception of AM-stereo signals in which a sum signal (L+R) is amplitude modulated on a carrier wave and a difference signal (L−R), together with a stereo program identification signal, is phase modulated on the same carrier wave, said FM demodulator is further coupled to said AM intermediate frequency amplifier, said FM demodulator comprising a network having two serially connected parallel resonant circuits, one tuned to the FM intermediate frequency and the other tuned to the AM intermediate frequency, and said receiver further comprising an integrating circuit coupled to the output of said FM demodulator, for forming said difference signal (L−R), an identification signal detection stage connected to said integrating circuit, a switching signal generating stage connected to the output of said detection stage, and switching means, having a control input coupled to said switching signal generating stage, for connecting said integrating circuit to said matrix circuit in which separate left and right stereo signals are formed from the sum signal of the amplitude demodulator and the difference signal of the integrating circuit.

* * * * *